US007456329B2

(12) United States Patent
Wu et al.

(10) Patent No.: US 7,456,329 B2
(45) Date of Patent: Nov. 25, 2008

(54) POLYOLEFINS FROM NON-CONVENTIONAL FEEDS

(75) Inventors: Margaret May-Som Wu, Skillman, NJ (US); Norman Yang, Westfield, NJ (US); Anatoly Ilich Kramer, Edison, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 301 days.

(21) Appl. No.: 11/291,001

(22) Filed: Nov. 30, 2005

(65) Prior Publication Data

US 2007/0123659 A1 May 31, 2007

(51) Int. Cl.
*C07C 9/22* (2006.01)
*C07C 2/08* (2006.01)
*C10L 1/16* (2006.01)

(52) U.S. Cl. ..... 585/18; 585/255; 585/326; 585/525

(58) Field of Classification Search ..... 585/10, 585/255, 326, 18, 525
See application file for complete search history.

(56) References Cited

U.S. PATENT DOCUMENTS

| | | | | |
|---|---|---|---|---|
| 2,388,942 A | | 11/1945 | Zimmerman | 260/683.6 |
| 3,149,178 A | | 9/1964 | Hamilton et al. | 260/683.9 |
| 3,382,291 A | | 5/1968 | Brennan | 260/683.15 |
| 3,742,082 A | | 6/1973 | Brennan | 260/683.9 |
| 3,780,128 A | | 12/1973 | Shubkin | 260/683.9 |
| 4,016,218 A | * | 4/1977 | Haag et al. | 585/467 |
| 4,172,855 A | | 10/1979 | Shubkin et al. | 585/16 |
| 4,650,917 A | * | 3/1987 | Dessau et al. | 585/329 |
| 4,956,122 A | | 9/1990 | Watts et al. | 252/565 |
| 5,082,986 A | | 1/1992 | Miller | 585/667 |
| 7,022,784 B2 | * | 4/2006 | Wu et al. | 526/170 |
| 2004/0082728 A1 | * | 4/2004 | Wu et al. | 525/338 |

FOREIGN PATENT DOCUMENTS

| | | |
|---|---|---|
| EP | 0 416 874 | 3/1991 |

OTHER PUBLICATIONS

Lubrication Fundamentals, J. G. Wills, Marcel Dekker Inc., entitled Synthetic Lubricants, pp. 75-80, New York, 1980.

* cited by examiner

*Primary Examiner*—Fred M Teskin

(57) ABSTRACT

Polyolefins made in accordance with the present invention are produced by polymerizing an unsaturated olefin or combination of unsaturated olefins to produce an unsaturated polyolefin, isomerizing the unsaturated polyolefin in the presence of an acid catalyst under conditions to produce a substantially unsaturated-isomerized polyolefin, and hydrogenating the unsaturated-isomerized polyolefin to produce a saturated isomerized polyolefin. A lube oil comprising the inventive saturated isomerized polyolefin is also disclosed.

43 Claims, No Drawings

POLYOLEFINS FROM NON-CONVENTIONAL FEEDS

FIELD OF THE INVENTION

The present invention relates to the field of lubricants. More particularly, this invention relates to polyolefins prepared from a feed comprising $C_8$ to $C_{24}$ alpha olefins.

BACKGROUND OF THE INVENTION

Poly-alphaolefins (PAOs) comprise one class of hydrocarbon lubricants which have achieved importance in the lubricating oil market. These materials are typically produced by the polymerization of alpha olefins, typically 1-octene, 1-decene, and 1-dodecene, with 1-decene being a preferred material, although polymers of lower olefins such as ethylene and propylene may also be used, including copolymers of ethylene with higher olefins, as described in U.S. Pat. No. 4,956,122 and the patents referred to therein.

The poly-alpha-olefin products may be obtained with a wide range of viscosities varying from highly mobile fluids of about 2 cSt at 100° C. to higher molecular weight, viscous materials which have viscosities exceeding 100 cSt at 100° C. The poly-alpha-olefins may be produced by the polymerization of olefin feed in the presence of a catalyst, such as, $AlCl_3$, $BF_3$, or $BF_3$ complexes, and hydrogen. Processes for the production of poly-alpha-olefin lubricants are disclosed, for example, in U.S. Pat. Nos. 3,382,291; 4,172,855; 3,742,082; 3,780,128; 3,149,178; 4,956,122; and 5,082,986. Poly-alpha-olefin lubricants are also discussed in Lubrication Fundamentals, J. G. Wills, Marcel Dekker Inc., (New York, 1980). The polymerization reaction is typically conducted in the absence of hydrogen; the lubricant range products are thereafter polished or hydrogenated in order to reduce the residual unsaturation. In the course of this reaction, the amount of unsaturation is generally reduced by greater than 90 wt %.

Normal alpha-olefins boiling in the lube oil range, in general $C_{20+}$, have unacceptably high pour points, i.e. >−20° C., and as such, are unsuitable for use as lube oils. The production of poly-alpha-olefin lube oils, however, is limited because poly-alpha-olefins conventionally made with $C_{14}$ and higher carbon number normal alpha-olefins have higher pour points compared to poly-alpha-olefins made with $C_8$ to $C_{12}$ normal alpha-olefins. Further, poly-alpha-olefins conventionally made with $C_{12}$ normal alpha-olefins have higher pour points compared to poly-alpha-olefins made with $C_8$ or $C_{10}$ normal alpha-olefins. Certain poly-alpha-olefins have several valuable properties, such as, low viscosities at low temperatures which improve cold engine starting, reduce friction and increase fuel efficiency, high viscosity indexes (i.e., >50), high thermal stability and oxidation resistance which prevents the buildup of sludge, and a high boiling range for its viscosity which minimizes evaporative loss.

Up to now, however, production has been limited to poly alpha olefins comprising $C_8$ or $C_{10}$ normal alpha-olefins because no process has been developed to convert higher carbon normal alpha-olefins to poly-alpha-olefins with low pour points and in high yield. The present invention is directed to overcoming this and other deficiencies in the art.

SUMMARY OF THE INVENTION

In a first aspect of the present invention, a process for preparing a saturated isomerized polyolefin comprises the steps of:

polymerizing a feed stock comprising an unsaturated olefin to form an unsaturated polyolefin;

isomerizing the unsaturated polyolefin in the presence of an acid catalyst in a substantially hydrogen-free environment to form an unsaturated-isomerized polyolefin; and hydrogenating the unsaturated-isomerized polyolefin to form the saturated isomerized polyolefin.

In another aspect of the present invention, a process for preparing a saturated isomerized polyolefin comprises the steps of:

polymerizing a feed stock comprising an unsaturated olefin to form an unsaturated polyolefin;

isomerizing the unsaturated polyolefin by contacting the unsaturated polyolefin with an acidic zeolite catalyst at a temperature of about 200° C. to about 475° C. in an essentially hydrogen free environment, to produce an unsaturated-isomerized polyolefin, wherein the zeolite catalyst has a constraint index of less than or equal to 12; and hydrogenating the unsaturated-isomerized polyolefin to produce a saturated isomerized polyolefin.

In yet another aspect of the present invention, a lube oil comprises the above saturated isomerized polyolefin.

Polyolefins (saturated isomerized polyolefins) made in accordance with the present invention are thus produced by polymerizing an unsaturated olefin or combination of unsaturated olefins to produce an unsaturated polyolefin, isomerizing the unsaturated polyolefin under non-hydrogenation conditions in the presence of an acid catalyst to produce an unsaturated-isomerized polyolefin, and hydrogenating the unsaturated-isomerized polyolefin.

In accordance with the present invention, unsaturated olefin feed stock includes, but is not limited to, $C_{8+}$ alpha-olefins and oligomers thereof either individually or in any combination thereof; $C_{10+}$ dimers, trimers, co-dimers, co-trimers, and higher oligomers of normal alpha-olefins either individually or in any combination thereof; $C_{10+}$ linear internal olefins and oligomers thereof either individually or in any combination thereof; $C_{8+}$ slightly branched alpha- or internal-olefins and oligomers thereof either individually or in any combination thereof; and a mixture of any combination of these unsaturated olefins and/or oligomers. Further, the unsaturated olefin feed stock may include $C_{24+}$ polyolefins, such as, linear alpha-polyolefins, slightly branched alpha-polyolefins, linear internal-polyolefins, slightly branched internal-polyolefins, individually or in any combination thereof, and in any combination with the above-described olefins.

Also, in accordance with the present invention, poly-alpha-olefins are produced by polymerizing an alpha-olefin or combination of alpha-olefins to produce an unsaturated poly-alpha-olefin, isomerizing the unsaturated poly-alpha-olefin under non-hydrogenation conditions in the presence of an acid catalyst to produce an unsaturated-isomerized poly-alpha-olefin, and hydrogenating the unsaturated-isomerized poly-alpha-olefin.

Acid catalysts employed in the present invention for the isomerization step include, but are not limited to, zeolites; homogeneous acid catalysts, such as Friedel-Crafts catalysts, Bronsted acids, and Lewis acids; acidic resins; acidic solid oxides; acidic silicoaluminophosphates; Group IVB, VB, and VIB metal oxides; hydroxide or free metal forms of Group VIII metals; and any combination thereof. In another aspect of the present invention, acid catalysts having an alpha value of at least 1 may be employed in the isomerization reaction.

DETAILED DESCRIPTION OF THE INVENTION

The present invention relates to a method for making saturated-isomerized polyolefins, referred to herein as lubes. Polyolefins made in accordance with the present invention are produced by polymerizing an unsaturated olefin or combination of unsaturated olefins to produce an unsaturated polyolefin. The unsaturated polyolefin is then isomerized in the presence of an acid catalyst under non-hydrogenation conditions to produce an unsaturated-isomerized polyolefin. The unsaturated-isomerized polyolefin is then hydrogenated to produce a saturated isomerized polyolefin. The saturated isomerized polyolefin may be employed as a finished lube base stock with excellent high-temperature and low-temperature properties, such as low volatility, low CCS viscosity, low pour point, and the like. The saturated isomerized polyolefin fluids of the present invention are characterized as having excellent oxidative stabilities.

In accordance with the present invention, unsaturated olefin feed stock includes, but is not limited to, $C_8$ and larger alpha-olefins and oligomers thereof either individually or in any combination thereof; $C_{10}$ and larger dimers, trimers, co-dimers, co-trimers, and higher oligomers of normal alpha-olefins either individually or in any combination thereof; $C_{10}$ and larger linear internal olefins and oligomers thereof either individually or in any combination thereof; $C_8$ and larger slightly branched alpha- or internal-olefins and oligomers thereof either individually or in any combination thereof; and a mixture of any combination of these unsaturated olefins and/or oligomers. Further, the unsaturated olefin feed stock may include $C_{24}$ and larger polyolefins, such as, linear alpha-polyolefins, slightly branched alpha-polyolefins, vinylidene olefins, linear internal-polyolefins, slightly branched internal-polyolefins, individually or in any combination thereof, and in any combination with the above-described olefins.

Also, in accordance with the present invention, poly-alpha-olefins are produced by polymerizing an alpha-olefin or combination of alpha-olefins to produce an unsaturated poly-alpha-olefin. The unsaturated poly-alpha-olefin is isomerized under non-hydrogenation conditions in the presence of an acid catalyst to produce an unsaturated-isomerized poly-alpha-olefin. Subsequently, the unsaturated-isomerized poly-alpha-olefin is hydrogenated to saturate the double bond in the isomerized poly-alpha-olefin. Such saturated-isomerized poly-alpha-olefin likewise may be employed as a finished lube base stock with excellent high-temperature and low-temperature properties.

Acid catalysts employed in the isomerization reaction of the present invention include, but are not limited to, zeolites; homogeneous acid catalysts, such as Friedel-Crafts catalysts, Bronsted acids, and Lewis acids; acidic resins; acidic solid oxides; acidic silicoaluminophosphates; Group IVB, VB, and VIB metal oxides; hydroxide or free metal forms of Group VIII metals; and any combination thereof. In another aspect of the present invention, acid catalysts having an alpha value of at least 1 may be employed in the isomerization reaction. In another aspect of the present invention, the acid zeolites with an alpha value of at least 1 may be employed in the isomerization reaction.

The process of the present invention provides a saturated-isomerized polyolefin product, interchangeably referred to herein as a "lube" or a base stock, which has excellent volatility and low temperature viscosity, from unsaturated olefins. For example, one embodiment of the process of the present invention provides a saturated poly-alpha-olefin product, which has excellent volatility and low temperature viscosity, from alpha-olefins which heretofore could not be utilized as poly-alpha-olefin feed to produce a commercially employable lubricant base stock.

Accordingly, the present invention provides flexibility in the selection of feed stock for the production of poly-alpha-olefins. The lubes produced in accordance with the present invention are characterized as having low viscosities, low pour points, and/or a high viscosity index.

Accordingly, the saturated-isomerized polyolefins (lubes) of the present invention may have a viscosity of 200 or less at 100° C., preferably less than 50 cSt at 100° C., with less than 10 cSt at 100° C. being more preferred. In an embodiment, the lubes of the present invention have a viscosity of from about 3 to about 200 cSt at 100° C.; and/or a viscosity of 200 or less at 40° C., preferably less than 50 cSt at 40° C., with less than 45 cSt at 100° C. being more preferred. In an embodiment, the lubes of the present invention have a viscosity of from about 4 to about 3000 cSt at 40° C.; and/or a pour points of less than or equal to about −20° C., more preferably less than or equal to about −30° C., more preferably less than or equal to about −40° C., and most preferably less than or equal to about −50° C.; and/or a viscosity index of greater than or equal to 50, preferably greater than or equal to 80, preferably greater than or equal to 90, preferably greater than or equal to 100, preferably with greater than or equal to 110 being preferred.

Further, the lubes of the present invention have low volatility, comparable to, or lower than polyalphaolefins lubes commercially available. In a preferred embodiment, the saturated isomerized polyolefin of the present invention has a volatility of less than or equal to a $C_8$-$C_{10}$ poly-alpha-olefin having a comparable molecular weight.

Accordingly, the combination of low viscosity, low volatility, and excellent viscometrics permits formulators to produce a wide cross grade of engine oils (e.g., 0W20 or 0W30) using the lubes of the present invention.

The present invention demonstrates that the isomerization of unsaturated or unhydrogenated polyolefins in an environment which is free of or substantially free of hydrogen (i.e., hydrogen is not intentionally added) provides excellent yields. For example, the isomerization of unsaturated alpha-olefins in an environment which is free of or substantially free of hydrogen provides improved yields as compared to the conventional isomerization of poly-alpha-olefin in an environment comprising hydrogen, which is defined for purposes herein to include an environment wherein hydrogen is intentionally added. As indicated in the examples below, the present invention produces a lube with high yields and a minimum amount of by-product formation during isomerization. Further, as indicated in the examples below, lube based stocks produced in accordance with the present invention have very low pour points and excellent low temperature viscometrics.

Poly-alpha-olefins made from $C_8$ to $C_{12}$ alpha-olefins have very low pour points, high viscosity index (VI), and excellent lubricating properties. The poly-alpha-olefins made from olefins larger than $C_{14}$ by $BF_3$ catalysts usually have higher pour points and are not suitable as high-performance synthetic base stocks. Poly-alpha-olefin made from $C_{14}$ and larger olefins by zeolites, such as MCM22, MCM56, USY, and the like, have much improved pour points as compared to poly-alpha-olefins made from conventional Friedel-Crafts catalyst. In the present invention polymers made from $C_{14}$ and larger alpha-olefins by conventional catalysts or zeolites are further improved by isomerization over a medium- or large-pore catalyst, such as a zeolite, without co-feeding hydrogen.

Additionally, the process of the present invention may also be employed to improve the properties, such as pour point, for poly-alpha-olefins made from conventional alpha-olefins, for example, 1-dodecene. After isomerization, the poly-alpha-olefins can be hydrogenated, if necessary, to produce saturated poly-alpha-olefins. The resulting saturated poly-alpha-olefins have excellent low temperature properties and can be made in high yields.

In the present invention, isomerization catalysts may be employed with or without a Group VIII metal. Because the reaction is conducted in an environment which is free or substantially free of hydrogen, the olefinic active center is not hydrogenated. Accordingly, isomerization of the feed olefin may occur in a lower temperature region, from about 200° C. to about 300° C., and thereby minimize cracking or side reactions to maintain high lube yields. Further, the acid catalyst used in the isomerization reaction of the present invention provides selective conversion of the waxy components, that is, the unsaturated polyolefin, to non-waxy components, that is, the unsaturated-isomerized polyolefin.

Accordingly, for purposes herein, an isomerized polyolefin is defined as a polyolefin that after isomerization has a lower pour point than that same polyolefin prior to the isomerization process. In other words, during the isomerization reaction, isomerization of the unsaturated polyolefin occurs to reduce its pour point below that of the unsaturated polyolefin feed. Upon hydrogenation of this unsaturated-isomerized polyolefin, a lube oil component is formed which has an improved (i.e., lower) pour point and preferably a higher viscosity index, compared to saturated product which has not been isomerized.

The catalytic isomerization conditions, such as temperature and pressure, depend upon the feed stock employed and the desired pour point of the lube produced. Generally, isomerization occurs at a temperature in a range between about 150° C. to about 475° C.; however, higher or lower temperatures may be employed. In another embodiment of the present invention, isomerization occurs at a temperature in a range between about 200° C. to about 450° C. Pressure is typically from about 1 psig to about 2000 psig, but higher or lower pressures may be employed. In another embodiment of the present invention, the pressure is between about 10 psig to about 1000 psig. Yet, in another embodiment of the present invention, the pressure is between about 100 psig to about 600 psig. Liquid hourly space velocity (LHSV) is from about 0.05 to about 20 during the isomerization reaction. In another aspect of the present invention, LHSV is from about 0.1 to about 5. Yet, in another embodiment of the present invention, LHSV is from about 0.1 to about 2.0. Low liquid hourly space velocity provides improved selectivity, thus resulting in more isomerization and less cracking of the feed and an increased product yield.

In the subsequent hydrogenation reaction, typically slight excess to large excess of hydrogen is used. Hydrogenation of the unsaturated-isomerized polyolefin may be conducted under the conditions described in U.S. Pat. No. 4,125,569, which is incorporated herein by reference. Unreacted hydrogen may be separated from the hydrogenated polyolefin lube product and recycled to the hydrogenation reaction zone.

Olefin Feed Stock

Feed stock which may be employed as a raw material to produce the saturated polyolefins of the present invention includes the following types of olefins and polyolefins:

1. Unsaturated $C_{8+}$ linear alpha-olefins, such as the linear $C_{10}$ to $C_{24}$ alpha-olefins, and oligomers thereof, either individually or in any combination thereof, may be employed in the present invention. Such alpha-olefins may be produced in accordance with conventional linear alpha-olefin technology, for example, an ethylene growth process, a wax cracking process, and a synthesis gas conversion process over modified Fischer-Tropsch process as discussed in Macromolecular Chemistry, Macromolecular Symposium, 1988, 12-14, p. 271-287, which is incorporated herein by reference.
2. $C_{10+}$ dimers and trimers, preferably $C_{12+}$ dimers and trimers, co-dimers, co-trimers, and higher oligomers of normal alpha-olefins, either individually or in any combination thereof, may be employed in the present invention.
3. $C_{10+}$ linear internal olefins, such as the $C_{12}$ to $C_{24}$ normal internal olefins, any combination thereof, or unsaturated oligomers thereof, either individually or in any combination thereof, may be readily employed in the present invention as feed stock. Such internal olefins can be produced from typical dehydrogenation of linear paraffins as discussed in U.S. Pat. No. 3,448,165 and Encyclopedia of Chemical Processing and Design, Vol. 15, Marcel Dekker, NJ, 1982, p. 266-284, both of which are incorporated herein by reference. These internal olefins can be polymerized to give unsaturated or substantially unsaturated polyolefins which are further processed in accordance with present invention.
4. $C_{8+}$ slightly branched alpha- or internal-olefins such as $C_{12}$ to $C_{24}$ branched olefins, any combination thereof, or unsaturated oligomers thereof, either individually or in any combination thereof, may be readily employed in the present invention. These olefins may be a by-product in linear alpha-olefin process, or from cracking of slightly branched wax or synthesis gas conversion. Examples of these olefins include 2-octyl tetradecene or its isomer olefins, methylpentadecenes, and the like. Accordingly, a slightly branched alpha- or internal olefin for purposes herein include olefins having less than 5, preferably less than 4, preferably less than 3, preferably less than 2, most preferably 1 branching chain per 10 carbon atoms present in the olefin.
5. A mixture of any combination of the above-described olefins may be employed in the present invention.
6. Unsaturated $C_{24+}$ polyolefins may be employed in the present invention. These unsaturated polyolefins include linear alpha-polyolefins, slightly branched alpha-polyolefins, linear internal-polyolefins, slightly branched internal-polyolefins, and any combination thereof. Although it is not necessary, these polyolefins may be further polymerized prior to the isomerization reaction.
7. A mixture of any combination of the above-described olefins, oligomers thereof, and polyolefins may be employed in the present invention. Although not required, such mixture may be polymerized in accordance with the present invention prior to isomerization. However, as indicated in the examples below, unpolymerized olefins may be removed from the mixture by distillation prior to isomerization, if desired. Further, the feed stock may include $C_2$ to $C_6$ unsaturated olefins, to include $C_4$ to $C_6$ alpha-olefins, with any of the above-described olefins and polyolefins.
8. A vinylidene olefins of general formula CH2═CR1R2 where R1 and R2 are long chain alkyl group of C1 to C40 and R1+R2 generally is greater than 12 carbons Processes for producing normal alpha-olefins are known in the art. Exemplary suitable processes are described in U.S. Pat. Nos. 3,477,813 and 3,482,000, both of which are incorporated herein by reference. Similarly, processes for producing poly-alpha-olefins are also known in the art. Exemplary suitable processes are described in U.S. Pat. Nos. 3,382,291 3,742,082, 6,703,356, all of which are incorporated herein by reference. Other catalysts suitable for the polyalpha-olefin synthesis include aluminum chloride, promoted aluminum chloride, alkylaluminum chlorides, or any other typical Friedel-Crafts polymerization catalysts. Other methods for synthesizing polyalpha-olefins can be found in "Synthetic Lubricants and High-Performance Functional Fluids, $2^{nd}$ Ed., edited by L. R. Rudnick and R. L. Shubkin, Marcel Dekker, Inc. 1999, Chapter 1, polyalpha-olefins, section III, p. 9 to 12.

Isomerization Catalysts

As indicated above, an acid catalyst is preferably employed as the isomerization catalyst in the isomerization reaction of the present invention. Examples of such catalysts which may be employed in the present invention include, but are not limited to, zeolites; homogeneous acid catalysts, such as Friedel-Crafts catalysts, Bronsted acids, and Lewis acids; acidic resins; acidic solid oxides; acidic silicoaluminophosphates; Group IVB, VB, and VIB metal oxides; hydroxide or free metal forms of Group VIII metals; and any combination thereof. Additionally, acid catalysts having an alpha value of at least about 1 may be employed in the isomerization reaction.

In a preferred embodiment, a zeolite, modified zeolites, or combination of zeolites, are employed in the process of the present invention. Preferred zeolites include, but are not limited to, a medium- or large-pore size zeolite. Preferred zeolites have a Constraint Index as defined herein of about 12 or less. Zeolites having a Constraint Index of 2-12 are generally regarded to be medium-pore size zeolites. Zeolites having a Constraint Index of less than 1 are generally regarded to be large-pore size zeolites. A characteristic of the crystal structure of this class of zeolites is that it provides a selective constrained access to, and egress from, the intra-crystalline free space by virtue of having an effective pore size between the small pore Linde A and the large pore Linde X, i.e., the pore windows of the structure are of about a size such as would be provided by 10-membered rings of silicon atoms interconnected by oxygen atoms. It is to be understood that these rings are those formed by the regular disposition of the tetrahedra making up the anionic framework of the crystalline aluminosilicate, the oxygen atoms themselves being bonded to the silicon (or aluminum, etc.) atoms at the centers of the tetrahedra. Briefly, in one embodiment of the present invention, zeolites useful as catalysts in this invention possess, in combination: a "Constraint Index" (defined hereinafter) of from about 1 to about 12; a silica to alumina ratio of at least about 12; and a structure providing a selective constrained access to the crystalline free space.

The silica to alumina mole ratio may be determined by conventional analysis. This ratio represents the silica to alumina ratio in the rigid anionic framework of the zeolite crystal and excludes aluminum which is present in the binder or which is present in cationic or other form within the channels. For example, zeolites with silica to alumina mole ratios of at least 12 may be employed in the present invention. In another embodiment of the present invention, zeolites having silica to alumina mole ratios of at least about 30 may be employed. In yet another embodiment of the present invention, in some instances, zeolites having substantially higher silica/alumina ratios, e.g., 1600 and above, may be employed.

Zeolites useful herein typically have an effective pore size of generally from about 5 to about 8 Angstroms, such as to freely sorb normal hexane. In addition, the structures provide constrained access to larger molecules. It is sometimes possible to estimate from a known crystal structure whether such constrained access exists. For example, if the only pore windows in a crystal are formed by 8-membered rings of silicon and aluminum atoms, then access by molecules of larger cross-section than normal hexane is generally excluded and the zeolite may not be of the desired type. Windows of 10-membered rings generally may be employed with the process of the present invention. Also 12-membered rings having constrained access may be employed with the process of the present invention. For example, the puckered 12-ring structure of TMA (tetramethyl ammonium) offretite, does show some constrained access.

A convenient measure of the extent to which a zeolite provides controlled access to molecules of varying sizes to its internal structure is the Constraint Index of the zeolite. The constraint index approximates the ratio of the cracking rate constants for the two hydrocarbons. Zeolites which provide a highly restricted access to and egress from its internal structure have a high value for the Constraint Index, and zeolites of this kind usually have pores of small size, e.g. less than 5 Angstroms.

On the other hand, zeolites which provide relatively free access to the internal zeolite structure have a low value for the Constraint Index, and usually pores of large size, e.g. greater than 8 Angstroms. A determination of the "constraint index" may be made by passing continuously a mixture of an equal weight of normal hexane and 3-methylpentane over a small sample, approximately 1 gram or less, of catalyst at atmospheric pressure according to the following procedure.

A sample of the catalyst, in the form of pellets or extrudate, is crushed to a particle size about that of coarse sand and mounted in a glass tube. Prior to testing, the catalyst is treated with a stream of air at 1000° F. for at least, 15 minutes. The catalyst is then flushed with helium and the temperature adjusted between 550° F. and 950° F. to give an overall conversion between 10% and 60%. The mixture of hydrocarbons is passed at 1 liquid hourly spaced velocity (i.e., 1 volume of liquid hydrocarbon per volume of catalyst per hour) over the catalyst with a helium dilution to give a helium to total hydrocarbon mole ratio of 4:1. After 20 minutes on stream, a sample of the effluent is taken and analyzed, by any conventional method and most conveniently by gas chromatography, to determine the fraction remaining unchanged for each of the two hydrocarbons.

The "constraint index" is calculated as follows:

$$\text{Constraint Index} = \frac{\log_{10}(\text{fraction of n-hexane remaining})}{\log_{10}(\text{fraction of 3-methylpentane remaining})}$$

The constraint index values typically used to characterize the specified zeolites described below (including some zeolites not specifically identified), are a cumulative result affected by several variables. Thus, for a given zeolite exhibiting a constraint index value within the range of about 1 to about 12, depending on the temperature within the aforenoted range of 550° F. to 950° F., and conversion between 10% and 60%, the constraint index may vary within the indicated approximate range of 1 to 12. Likewise, other variables such as the crystal size of the zeolite, the presence of possibly occluded contaminants and binders intimately combined with the zeolite may affect the constraint index. It will accordingly be understood by those skilled in the art that the constraint index, while affording a highly useful means for characterizing the zeolites of interest, is dependant on the test conditions. However, in all instances, at a temperature within the above-specified range of 550° F. to 950° F., the constraint index will have a value for any given zeolite of interest herein within the approximate range of 1 to 12.

Constraint Index (CI) values for some typical materials are:

| Catalyst | CI (at test temperature) |
|---|---|
| ZSM-4 | 0.5 (316° C.) |
| ZSM-5 | 6-8.3 (371° C.-316° C.) |
| ZSM-11 | 5-8.7 (371° C.-316° C.) |
| ZSM-12 | 2.3 (316° C.) |
| ZSM-20 | 0.5 (371° C.) |
| ZSM-22 | 7.3 (427° C.) |
| ZSM-23 | 9.1 (427° C.) |
| ZSM-34 | 50 (371° C.) |
| ZSM-35 | 4.5 (454° C.) |
| ZSM-38 | 2.0 (427° C.) |
| ZSM-48 | 3.5 (538° C.) |
| ZSM-50 | 2.1 (427° C.) |
| TMA Offretite | 3.7 (316° C.) |
| TEA Mordenite | 0.4 (316° C.) |
| Clinoptilolite | 3.4 (510° C.) |
| Mordenite | 0.5 (316° C.) |
| REY | 0.4 (316° C.) |
| Amorphous Silica-Alumina | 0.6 (538° C.) |
| Dealuminized Y | 0.5 (510° C.) |
| Erionite | 38 (316° C.) |
| Zeolite Beta | 0.6-2.0 (316° C.-399° C.) |

The above-described Constraint Index is a generally useful parameter for identifying those zeolites which may be employed in the instant invention. Therefore, it will be appreciated that it may be possible to so select test conditions, e.g. temperature, as to establish more than one value for the Constraint Index of a particular zeolite. This explains the range of Constraint Indices for some zeolites, such as ZSM-5, ZSM-11 and Beta.

One class of zeolites contemplated herein is exemplified, but not limited to, by ZSM-5, ZSM-11, ZSM-12, ZSM-22, ZSM-23, ZSM-35, ZSM-38, and ZSM-48.

ZSM-5 is described in greater detail in U.S. Pat. Nos. 3,702,886 and Re. 29,948. The entire descriptions contained within those patents, particularly the X-ray diffraction pattern of therein disclosed ZSM-5, are incorporated herein by reference.

ZSM-11 is described in greater detail in U.S. Pat. No. 3,709,979. That description, and in particular the X-ray diffraction pattern of said ZSM-11, is incorporated herein by reference.

ZSM-12 is described in U.S. Pat. No. 3,832,449. That description, and in particular the X-ray diffraction pattern disclosed therein, is incorporated herein by reference.

ZSM-22 is described in U.S. Pat. No. 4,556,477, the entire contents of which is incorporated herein by reference.

ZSM-23 is described in U.S. Pat. No. 4,076,842. The entire content thereof, particularly the specification of the X-ray diffraction pattern of the disclosed zeolite, is incorporated herein by reference.

ZSM-35 is described in U.S. Pat. No. 4,016,245. The description of that zeolite, and particularly the X-ray diffraction pattern thereof, is incorporated herein by reference.

ZSM-38 is more particularly described in U.S. Pat. No. 4,406,859. The description of that zeolite, and particularly the specified X-ray diffraction pattern thereof, is incorporated herein by reference.

ZSM-48 is more particularly described in U.S. Pat. No. 4,234,231, the entire contents of which is incorporated herein by reference.

The large-pore zeolites, including those zeolites having a Constraint Index less than 2, are well known in the art and have a pore size sufficiently large to admit the vast majority of components normally found in a feed chargestock. The large-pore zeolites are generally stated to have a pore size in excess of 6 Angstroms and are represented by zeolites having the structure of, e.g., Zeolite Beta, Zeolite UHP—Y, Zeolite Y, Ultrastable Y (USY), Dealuminized Y, Mordenite, ZSM-3, ZSM-4, ZSM-14, ZSM-18, and ZSM-20. A crystalline silicate zeolite well known in the art and also useful in the present invention is faujasite. The ZSM-20 zeolite resembles faujasite in certain aspects of structure, but has a notably higher silica/alumina ratio than faujasite, as does Dealuminized Y.

Zeolite ZSM-14 is described in U.S. Pat. No. 3,923,636. That description is incorporated herein by reference.

Zeolite ZSM-20 is described in U.S. Pat. No. 3,972,983. That description is incorporated herein by reference.

Zeolite Beta is described in U.S. Pat. Nos. 3,308,069 and Re. No. 28,341. These respective descriptions are incorporated herein by reference.

Zeolite Y and Ultrastable Y are described in U.S. Pat. No. 4,962,269. These descriptions are incorporated herein by reference.

Low sodium Ultrastable Y molecular sieve (USY) is described in U.S. Pat. Nos. 3,293,192 and 3,449,070. These respective descriptions are incorporated herein by reference.

Dealuminized Y zeolite may be prepared by the method found in U.S. Pat. No. 3,442,795. That description is incorporated herein by reference.

Zeolite UHP—Y is described in U.S. Pat. No. 4,401,556. That description is incorporated herein by reference.

Accordingly, in a preferred embodiment, the catalyst may comprise or further comprise a homogeneous acid catalyst; an acidic resin; an acidic solid oxide; an acidic silicoaluminophosphate; a Group IVB metal oxide; an oxide of a Group VIII, IVA, or VB metal, a hydroxide of a Group VIII, IVA, or VB metal, a free of Group VIII, IVA, or VB metal; or any combination thereof.

Preferably, the acid catalyst is a zeolite containing one or more Group VI B to VIIIB metal elements. More preferably, the acid catalyst is a zeolite containing one or more metals selected from the group consisting of Pt, Pd, Ni, Co, Rh, Ir, Ru, W, Mo, and a combination thereof.

In general, homogeneous acid catalysts may be employed for the isomerization process to improve the low temperature properties of the lube base stocks. The types of homogenous catalysts include Friedel-Crafts catalysts, Bronsted acids, and Lewis acids. Examples are boron halides ($BF_3$, $BCl_3$, $BBr_3$), aluminum halides ($AlC_3$, $AlBr_3$), $SbF_5$, $TiCl_3$, $TiCl_4$, $SnCl_4$, $PF_5$, $SnF_4$, $H_2SO_4$, HCOOH, HF, HCl, HBr, triflic acid, and the like. These homogeneous acids can be mixed with the feed lube base stocks and heated to a temperature sufficient to cause the isomerization reaction to produce the unsaturated-isomerized polyolefin. When the reaction is complete, the homogenous catalyst can be removed by washing with water and/or with dilute aqueous acid or base, and separating the aqueous layer from the organic lube composition. The lube composition can then be hydrogenated to remove unsaturation in the polymer. The finished lube will generally exhibit excellent low temperature properties.

In addition to solid zeolitic material for use as catalyst, other types of solid acidic catalysts can also be used. Examples include, but are not limited to, acidic resins, such as acidic ion-exchange resins (AMBERLITE IR 120 PLUS™, AMBERLITE IRC-50™, AMBERLITE IRP-69™, AMBERLYST 15™, AMBERLYST 36™, DOWEX 50W™ series, DOWEX HCR-W2™, DOWEX 650C™, DOWEX MARATHON C™, DOWEX DR-2030™, NAFION™ series, and the like. When solid ion-exchange resins are employed as catalysts, the processing steps can be similar as in zeolite catalysts. They can be used in fixed bed, slurry reactor, or CSTR-type reactor.

Acidic solid oxides may be employed as an isomerization catalyst in the present invention. A particular acidic solid oxide which may be employed in one embodiment of the process of the present invention is MCM-36. MCM-36 is a pillared layered material having zeolitic layers. MCM-36 is described in U.S. Pat. Nos. 5,250,277 and 5,292,698. These respective descriptions are incorporated herein by reference.

Additionally, MCM-22, MCM-49, MCM-56, and MCM-68 are useful acidic solid oxides for catalyzing the isomerization reaction of the present invention. MCM-22 is described in U.S. Pat. Nos. 4,992,606; 5,077,445; and 5,334,795, and such descriptions respectively are incorporated herein by reference. MCM-49 is described in U.S. Pat. No. 5,236,575. Such description is incorporated herein by reference. MCM-56 is described in U.S. Pat. No. 5,600,048. Such description is incorporated herein by reference. MCM-68 is described in U.S. Pat. No. 6,049,018, and such description is incorporated herein by reference.

MCM-56 is a layered material having a composition involving the molar relationship:

$$X_2O_3:(n)YO_2,$$

wherein X is a trivalent element, such as aluminum, boron, iron, and/or gallium; Y is a tetravalent element such as silicon and/or germanium; and n is less than about 35, e.g., from about 5 to less than about 25, usually from about 10 to less than about 20, more usually from about 13 to about 18. In the as-synthesized form, the material has a formula, on an anhydrous basis and in terms of moles of oxides per n moles of $YO_2$, as follows:

$$(0\text{-}2)M_2O:(1\text{-}2)R:X_2O_3:(n)YO_2,$$

wherein M is an alkali or alkaline earth metal, and R is an organic moiety. The M and R components are associated with the material as a result of their presence during synthesis, and are easily removed by post-synthesis as described in U.S. Pat. No. 5,600,048.

The MCM-56 material may be thermally treated and in the calcined form exhibits high surface area (greater than 300 $m^2/gm$) and unusually large sorption capacity for certain large molecules when compared to materials such as calcined PSH-3, SSZ-25, MCM-22, and MCM-49, all of which are described in U.S. Pat. No. 5,600,048. The MCM-56 wet cake, i.e., as-synthesized MCM-56, is swellable indicating the absence of interlayer bridges, in contrast with MCM-49 which is unswellable.

To the extent desired, the original alkali or alkaline earth, e.g., sodium, cations of the as-synthesized material can be replaced in accordance with techniques well known in the art, at least in part, by ion exchange with other cations. Replacement cations include metal ions, hydrogen ions, hydrogen precursor, e.g., ammonium, ions, and mixtures thereof. Further, replacement cations include cations which tailor the catalytic activity for certain hydrocarbon conversion reactions. These include hydrogen, rare earth metals, and metals of Groups IIA, IIIA, IVA, IB, IIB, IIIB, IVB, and VIII of the Periodic Table of the Elements.

The acidic solid oxide crystals can be shaped into a wide variety of particle sizes. Generally speaking, the particles can be in the form of a powder, a granule, or a molded product such as an extrudate having a particle size sufficient to pass through a 2 mesh (Tyler) screen and be retained on a 400 mesh (Tyler) screen. In cases where the catalyst is molded, such as by extrusion, the crystals can be extruded before drying or partially dried and then extruded.

The acidic solid oxide crystalline material may be composited with another material which is resistant to the temperatures and other conditions employed in the process of this invention. Such materials include active and inactive materials and synthetic or naturally occurring zeolites as well as other inorganic materials such as clays and/or oxides such as alumina, silica, silica-alumina, zirconia, titania, magnesia, or mixtures of these and other oxides. Such inorganic oxides may be either naturally occurring or in the form of gelatinous precipitates or gels including mixtures of silica and metal oxides.

Clays may also be included with the oxide type binders to modify the mechanical properties of the catalyst or to assist in its manufacture. Use of a material in conjunction with the acidic solid crystal, i.e., combined therewith or present during its synthesis, which itself is catalytically active may change the conversion and/or selectivity of the catalyst. Inactive materials may serve as diluents to control the amount of conversion so that products can be obtained economically and without employing other means for controlling the rate of reaction. These materials may be incorporated into naturally occurring clays, e.g., bentonite and kaolin, to improve the crush strength of the catalyst under commercial operating conditions and to function as binders or matrices for the catalyst.

The relative proportions of finely divided solid acid and crystalline material and inorganic oxide matrix vary widely, with the solid acid crystal content ranging from about 1 to about 90 percent by weight and more usually, particularly when the composite is prepared in the form of beads, in the range of about 2 to about 80 weight percent of the composite.

An intermediate pore size acidic silicoaluminophosphates may be employed as an isomerization catalyst in one embodiment of the present invention. Examples of such silicoaluminophosphates include, but are not limited to SAPO-11, SAPO-31, and SAPO-41. Optionally, the silicoaluminophosphates may be combined with a platinum or palladium component.

SAPO-11 is an intermediate pore size silicoaluminophosphate acidic molecular sieve and is described in U.S. Pat. Nos. 4,440,871 and 5,082,986. Such descriptions respectively are incorporated herein by reference. The SAPO-11 intermediate pore size silicoaluminophosphate molecular sieve comprises a molecular framework of corner-sharing ($SiO_2$) tetrahedra, ($AlO_2$) tetrahedra, and ([$PO_2$) tetrahedra [i.e., $(Si_xAl_yP)O_2$ tetrahedral units].

SAPO-31 is an intermediate pore size silicoaluminophosphate acidic molecular sieve having a three-dimensional microporous crystal framework of ($PO_2$), ($AlO_2$), and ($SiO_2$). SAPO-31 is described in U.S. Pat. No. 5,082,986, and such description is incorporated herein by reference.

SAPO-41 is an intermediate pore size silicoaluminophosphate acidic molecular sieve having a three-dimensional microporous crystal framework structure of ($PO_2$), ($AlO_2$), and ($SiO_2$) tetrahedral units. SAPO-41 is described in U.S. Pat. No. 5,082,986, and such description is incorporated herein by reference.

Another type of solid acidic catalyst which may be employed as the isomerization catalyst comprises a Group IVB metal oxide, such as zirconia or titania, modified with an oxyanion of an Group VIB metal, such as an oxyanion of tungsten, such as tungstate. The modification of the Group IVB metal oxide with the oxyanion of the Group VIB metal is believed to impart acid functionality to the material. An example of a modification of a Group IVB metal oxide, particularly, zirconia, with a Group VIB metal oxyanion, particularly tungstate, is described in U.S. Pat. No. 5,113,034; in Japanese Kokai Patent Application No. Hei 1 [1989]-288339; and in an article by K. Arata and M. Hino in Proceedings 9th International Congress on Catalysis, Volume 4, pages 1727-1735 (1988), the entire disclosures of which are incorporated herein by reference.

For the purposes of the present disclosure, the expression, Group IVB metal oxide modified with an oxyanion of a Group VIB metal, is intended to connote a material comprising a Group VIB metal, and oxygen, with more acidity than a simple mixture of separately formed Group IVB metal oxide mixed with a separately formed Group VIB metal oxide or oxyanion. Although not wishing to be bound by any particular theory, the present Group IVB metal, e.g., zirconium, oxide modified with an oxyanion of a Group VIB metal, e.g., tungsten, is believed to result from an actual chemical interaction between a source of a Group IVB metal oxide and a source of a Group VIB metal oxide or oxyanion.

Other elements, such as alkali (Group IA) or alkaline earth (Group IIA) compounds may optionally be added to the present catalyst to alter catalytic properties. The addition of such alkali or alkaline earth compounds to the present catalyst may enhance the catalytic properties of components thereof, e.g., Pt or W, in terms of their ability to function as a hydrogenation/dehydrogenation component or an acid component.

The Group IVB metal (i.e., Ti, Zr or Hf) and the Group VIB metal (i.e., Cr, Mo or W) species of the present catalyst are not limited to any particular valence state for these species. These species may be present in this catalyst in any possible positive oxidation value for these species. Subjecting the catalyst, e.g., when the catalyst comprises tungsten, to reducing conditions, e.g., sufficient to reduce the valence state of the tungsten, may enhance the overall catalytic ability of the catalyst to catalyze certain reactions, e.g., the isomerization of n-hexane.

Suitable sources of the Group IVB metal oxide, used for preparing the modified Group IVB metal oxide catalyst, include compounds capable of generating such oxides, such as oxychlorides, chlorides, nitrates, etc., particularly of zirconium or titanium. Alkoxides of such metals may also be used as precursors or sources of the Group IVB metal oxide. Examples of such alkoxides include, but are not limited to, zirconium n-propoxide and titanium i-propoxide. Preferred sources of a Group IVB metal oxide are zirconium hydroxide, i.e., $Zr(OH)_4$, and hydrated zirconia. The expression, hydrated zirconia, is intended to connote materials comprising zirconium atoms covalently linked to other zirconium atoms via bridging oxygen atoms, i.e., Zr—O—Zr, further comprising available surface hydroxy groups. These available surface hydroxyl groups are believed to react with the source of an anion of a Group IVB metal, such as tungsten, to form the modified Group IVB metal oxide acidic catalyst component. As suggested in the aformentioned article by K. Arata and M. Hino in Proceedings 9th International Congress on Catalysis, Volume 4, pages 1727-1735 (1988), precalcination of $Zr(OH)_4$ at a temperature of from about 100° C. to about 400° C. results in a species which interacts more favorably with tungstate. This precalcination is believed to result in the condensation of ZrOH groups to form a polymeric zirconia species with surface hydroxyl groups. This species resulting from precalcination is referred to herein as a form of a hydrated zirconia.

Treatment of hydrated zirconia with a base solution prior to contact with a source of tungstate may be employed. Further, refluxing hydrated zirconia in an $NH_4OH$ solution having a pH of greater than 7, e.g., about 9, may be employed.

Suitable sources for the oxyanion of the Group VIB metal, such as molybdenum or tungsten, include, but are not limited to, ammonium metatungstate or metamolybdate, tungsten or molybdenum chloride, tungsten or molybdenum carbonyl, tungstic or molybdic acid, and sodium tungstate or molybdate.

The modified Group IVB metal oxide catalyst may be prepared, for example, by impregnating the hydroxide or oxide, particularly the hydrated oxide, of the Group IVB metal with an aqueous solution containing an anion of the Group VIB metal, preferably tungstate or molybdate, followed by drying. Calcination of the resulting modified Group IVB material may be carried out, preferably in an oxidizing atmosphere, at temperatures from about 500° C. to about 900° C. in one embodiment of the present invention, from about 700° C. to about 850° C. in another embodiment of the present invention, and from about 750° C. to about 825° C. in yet another embodiment of the present invention. The calcination time may be up to 48 hours in one embodiment of the present invention, for about 0.5-24 hours in another embodiment of the present invention, and for about 1.0-10 hours in yet another embodiment of the present invention. For example, calcination may be carried out at about 800° C. for about 1 to about 3 hours.

When a source of the hydroxide or hydrated oxide of zirconium is used, calcination, e.g., at temperatures greater than about 500° C., of the combination of this material with a source of an oxyanion of tungsten may be needed to induce the desired degree of acidity to the overall material. However, when more reactive sources of zirconia are used, it is possible that such high calcination temperature may not be needed.

In the modified Group IVB metal oxide catalyst, of the Group IVB oxides, zirconium oxide may be employed; and of the Group VIB anions, tungstate may be employed.

Qualitatively speaking, any conventional method of elemental analysis of the modified Group IVB metal oxide catalyst will reveal the presence of Group IVB metal, Group VIB metal, and oxygen. The amount of oxygen measured in such an analysis will depend on a number of factors, such as the valence state of the Group IVB and Group VIB metals, the form of the hydrogenation/dehydrogenation component, moisture content, etc. Accordingly, in characterizing the composition of the catalyst according to the present invention, it is best not to be restricted by any particular quantities of oxygen. In functional terms, the amount of Group VIB oxyanion in the present catalyst may be expressed as that amount which increases the acidity of the Group IVB oxide. This amount is referred to herein as an acidity increasing amount. Elemental analysis of the present catalyst may be used to determine the relative amounts of Group IVB metal and Group VIB metal in the catalyst. From these amounts, mole ratios in the form of $XO_2/YO_3$ may be calculated, where X is the Group IVB metal, assumed to be in the form $XO_2$, and Y is the Group VIB metal, assumed to be in the form of $YO_3$. It will be appreciated, however, that these forms of oxides, i.e., $XO_2$ and $YO_3$, may not actually exist, and are referred to herein simply for the purposes of calculating relative quantities of X and Y in the present catalyst. The present catalysts may have calculated mole ratios, expressed in the form of $XO_2/YO_3$, where X is at least one Group IVB metal (i.e., Ti, Zr, and Hf) and Y is at least one Group VIB metal (i.e., Cr, Mo, or W), of up to 1000, e.g., up to 300, e.g., from 2 to 100, e.g., from 4 to 30.

In an optional modification of the Group IVB metal oxide described herein, a hydrogenation/dehydrogenation component may be combined with the Group IVB metal oxide, the zeolites, the SAPOs or the acid clays. This hydrogenation/ dehydrogenation component imparts the ability of the material to catalyze the addition of hydrogen to or the removal of hydrogen from organic compounds, such as hydrocarbons, optionally substituted with one or more heteroatoms, such as oxygen, nitrogen, metals or sulfur, when the organic compounds are contacted with the modified material under sufficient hydrogenation or dehydrogenation conditions.

During the isomerization reaction according to the present invention, an independent source or feed of hydrogen, such as hydrogen gas, is not provided to the isomerization reaction environment. Accordingly, the formation of a saturated, isomerized polyolefin during the isomerization reaction is substantially prevented, if not altogether, thereby providing an isomerized polyolefin which is unsaturated. The catalyst may be employed in the isomerization reaction and thereafter carried forward with the isomerized polyolefin to the hydrogenation reaction to subsequently saturate the isomerizated polyolefin.

It is noted, however, that during the isomerization reaction of the polyolefin to form the unsaturated-isomerized polyolefin in accordance with the present invention, hydrogen should not be introduced into the isomerization reaction environment. Accordingly, sufficient hydrogenation conditions should not exist to hydrogenate the polyolefin. However, it is recognized that hydrogen adventitious could be introduce into the isomerization reaction environment either by an outside source or by hydrogen liberation from the olefin or polyolefin via cracking and the like during the process without substantially effecting yields or product properties. Accordingly, this aspect is considered within the scope of the present invention.

Examples of hydrogenation/dehydrogenation components include, but are not limited to, the oxide, hydroxide, or free metal (i.e., zero valent) forms of Group VIII metals (i.e., Pt, Pd, Ir, Rh, Os, Ru, Ni, Co, and Fe), Group IVA metals (i.e., Sn and Pb), Group VB metals (i.e., Sb and Bi), and Group VIIB metals (i.e., Mn, Tc and Re). The present catalyst may comprise one or more catalytic forms of one or more noble metals (i.e., Pt, Pd, Ir, Rh, Os, or Ru). Combinations of catalytic forms of noble or non-noble metals and combinations of Pt with Sn may be used. The valence state of the metal of the hydrogenation/dehydrogenation component is preferably in a reduced valance state, e.g., when this component is in the form of an oxide or hydroxide. The reduced valence state of this metal may be attained, in situ, during the course of a reaction, when a reducing agent, such as hydrogen, is included in the feed to the reaction as indicated above, for a pre-determined period to reduce the metal. Or more preferably, the reduced metal is obtained by pre-reducing the metal oxide or hydroxides with reducing agent, usually hydrogen. After the metal is reduced, the hydrogen is discontinued and the olefin feed is then passed through this solid catalyst for isomerization. The presence of metal, working together with the acid sites of the catalyst, catalyzes or promotes the isomerization reaction of the olefins.

The acidic solid material prepared as above for use herein can be shaped into a wide variety of particle sizes. Generally, the particles can be in the form of a powder, a granule, or a molded product, such as an extrudate having particle size sufficient to pass through a 2 mesh (Tyler) screen and be retained on a 400 mesh (Tyler) screen. In cases where the catalyst is molded, such as by extrusion, the acidic solid can be extruded before drying or partially dried and then extruded.

As mentioned previously, the modified Group IVB metal oxide catalyst can optionally be used in intimate combination with a hydrogenating component such as tungsten, vanadium, molybdenum, rhenium, nickel, cobalt, chromium, manganese, or a noble metal such as platinum or palladium. Such component can be introduced in the catalyst composition by way of co-precipitation, exchanged into the composition, impregnated therein, or intimately physically admixed therewith. Such component can be impregnated in, or on, the acidic solid material such as, for example, in the case of platinum, by treating the acidic solid material with a solution containing a platinum metal-containing ion. Thus, suitable platinum compounds for this purpose include chloroplatinic acid, platinum halides, and various compounds containing the platinum ammine complex.

Prior to its use in a catalytic process, the acidic solid material may be dehydrated, at least partially. This can be done by heating the solid material to a temperature in the range of from about 200° C. to about 595° C. in an atmosphere such as air, nitrogen, etc., and at atmospheric, subatmospheric, or superatmospheric pressures for between about 30 minutes to about 48 hours. Dehydration can also be performed at room temperature merely by placing the material in a vacuum, but a longer time is required to obtain a sufficient amount of dehydration.

It may be desired to incorporate the acidic solid material with another material resistant to the temperatures and other conditions employed in organic conversion processes. Such other materials include active and inactive materials and synthetic or naturally occurring zeolites as well as inorganic materials such as clays, silica, and/or metal oxides such as alumina. The latter may be either naturally occurring or in the form of gelatinous precipitates or gels including mixtures of silica and metal oxides. Use of another material in conjunction with the acidic solid material, i.e., combined therewith or present during synthesis of the acidic solid material, which is active, tends to change the conversion and/or selectivity of the catalyst in certain organic conversion processes. Inactive materials suitably serve as diluents to control the amount of conversion in a given process so that products can be obtained economically and orderly without employing other means for controlling the rate of reaction. The acidic solid materials may be incorporated into naturally occurring clays, e.g., bentonite and kaolin, to improve the crush strength of the catalyst under commercial operating conditions. These other materials, i.e., clays, oxides, etc., function as binders for the catalyst. It is desirable to provide a catalyst having good crush strength because in commercial use it is desirable to prevent the catalyst from breaking down into powder-like materials. These clay and/or oxide binders have been employed generally for the purpose of improving the crush strength of the catalyst.

Naturally occurring clays which can be composited with the acidic solid material include, but are not limited to, the montmorillonite and kaolin family, which families include the subbentonites, and the kaolins commonly known as Dixie, McNamee, Georgia and Florida clays or others in which the main mineral constituent is halloysite, kaolinite, dickite, nacrite, or anauxite. Such clays can be used in the raw state as originally mined or initially subjected to calcination, acid treatment, or chemical modification. Binders useful for compositing with the present acidic solid material also include inorganic oxides, notably alumina.

In addition to the foregoing materials, the acidic solid material can be composited with a porous matrix material such as silica-alumina, silica-magnesia, silica-zirconia, silica-thoria, silica-beryllia, silica-titania as well as ternary compositions such as silica-alumina-thoria, silica-alumina-zirconia silica-alumina-magnesia, and silica-magnesia-zirconia.

The relative proportions of finely divided acidic solid material and inorganic oxide matrix vary widely, with the crystal content ranging from about 1 to about 90 percent by weight and more usually, particularly when the composite is prepared in the form of beads, in the range of about 2 to about 80 weight percent of the composite. Such Group IVB metal oxide catalysts are describe in U.S. Pat. No. 5,516,954.

As described above, in another embodiment of the present invention, acid catalysts having an alpha value of at least 1 may be employed to catalyze isomerization reaction. As is known in the art, and as used in this application, the acidity of a catalyst may be measured by its alpha value. The alpha value is an approximate indication of the catalytic cracking activity of the catalyst compared to a standard catalyst and it gives the relative rate constant (rate of normal hexane conversion per volume of catalyst per unit time). It is based on the activity a highly-active silica-alumina zeolite cracking catalyst taken as an alpha of 1 (Rate Constant=0.016 sec.−1). In the case of zeolite HZSM-5, only 174 ppm of tetrahedrally coordinated $Al_2O_3$ are required to provide an alpha value of 1. The Alpha Test is described in U.S. Pat. No. 3,354,078, in The Journal of Catalysis, 6, pp. 522-529 (August 1965), and in The Journal of Catalysis, 61, p. 395 (1980), each incorporated herein by reference as to that description.

The isomerization reaction in accordance with the present invention may be conducted by contacting the feed stock with a fixed stationary bed of catalyst or with a moving bed reactor. As indicated in the examples below, a trickle-bed configuration may be employed. In the trickle-bed configuration, the feed is allowed to trickle through a stationary fixed bed of catalyst during the isomerization reaction of the present invention. Additionally, the isomerization reaction can be carried out in a batch slurry reactor or in a continuous stir tank reactor.

Hydrogenation

Upon completion of the isomerization reaction described above, the substantially unsaturated-isomerized polyolefin is reacted with hydrogen to hydrogenate and saturate the polyolefin. Any conventional hydrogenation reaction may be employed in the present invention. For example, the hydrogenation process described in U.S. Pat. No. 4,125,569, which is incorporated herein by reference, may be employed in the present invention. Hydrogenation catalysts include, but are not limited to, Ni-on Kieselguhr catalyst and conventional metallic hydrogenation catalysts, for example, oxide, hydroxide, or free metal forms of the Group VIII metals, such as cobalt, nickel, palladium, and platinum. The metals are typically associated with carriers such as bauxite, alumina, silica gel, silica-alumina composites, activated carbon, crystalline aluminosilicate zeolites, and clay. Also, non-noble Group VIII metals, metal oxides, and sulfides can be used. Additional examples of catalysts which may be employed in the hydrogenation reaction are disclosed in U.S. Pat. Nos. 3,852,207; 4,157,294; 3,904,513; and 4,673,487, which are incorporated herein by reference. All of the catalysts mentioned above may be employed separately or in combination with one another.

The hydrogenation can also be accomplished under hydrogen pressure using the same metal-containing isomerization zeolites, such as PtZSM48, Pt-beta or other metal-modified zeolites, after the first isomerization in absence of hydrogen. Example of this operation would be to first mix the olefin feed with a metal containing catalyst for isomerization. When the isomerization is completed, hydrogen can be added to the system to initiated hydrogenation reaction using the same metal-containing isomerization catalyst. This operation would have the advantage of using one catalyst for both steps.

The physical form of the catalyst employed in either the isomerization or hydrogenation reactions depends on the type of catalytic reactor being employed and may be in the form of a granule or powder, and may be compacted into an agglomerated form, usually with a silica or alumina binder for fluidized bed reaction, or pills, prills, spheres, extrudates, or other shapes of controlled size to accord adequate catalyst-reactant contact. The catalyst may be employed either as a fluidized catalyst, or in a fixed or moving bed in a batch reactor or a continuous stir tank reactor, and in one or more reaction stages. Additionally, as indicated above, the catalyst may be in the form of a liquid.

The lube oil produced in accordance with the present invention may be used as a blending component with other synthetic fluids, such as polyalphaolefins, esters, polyethers, polyalkyleneglycols (PAG), polyisobutylene (PIB), alkylaromatics or polyalkylarometics, etc. The lube oil can also be used as a blending component with Grade I or Grade II mineral oils to improve the viscosity and viscosity index properties of those oils and can be combined with isomerized petroleum wax or Grade III base stocks or isomerized lube oils derived from Fisher-Tropsch wax.

In addition, additives of one or more of the following: thickeners, VI improvers, antioxidants, anti-wear additives, detergent/dispersant/inhibitor (DDI) packages, and/or anti-rust additives may be added to the base stock prepared in this invention or the blends of this inventive fluid with other fluids as described above. In a preferred embodiment the fluids or the blends herein are combined with one or more of dispersants, detergents, friction modifiers, traction improving additives, de-emulsifiers, defoamants, chromophores (dyes), and/or haze inhibitors. These fully formulated lubricants can be used in automotive crank case oil (engine oil), industrial oil, grease, or gas turbine engine oil. These are examples of additives used in finished lubricant formulations. Additional information on the use of PAO's in the formulations of full synthetic, semi-synthetic or part synthetic lubricant or functional fluids can be found in "Synthetic Lubricants and High-Performance Functional Fluids", 2nd Ed. L. Rudnick, etc. Marcel Dekker, Inc., N.Y. (1999). Additional information on additives used in product formulation can be found in "Lubricants and Lubrications, Ed. By T. Mang and W. Dresel, by Wiley-VCH GmbH, Weinheim 2001.

EXAMPLES

The following examples demonstrated that the $C_{14}$ and higher linear alpha-olefins can be converted into high quality lube base stock poly-alpha-olefin by first polymerization of the large olefins by acid catalysts, such as, zeolites, $BF_3$ catalysts, and acidic solid oxides, followed by isomerization by reacting the unhydrogenated poly-alpha-olefin over an acidic zeolite with medium or large pore sizes to form an unsaturated-isomerized poly-alpha-olefin, and then hydrogenation to saturate the polyolefins. The finished lube has significantly improved low temperature properties, pour points, VI, and volatility.

In the following examples, the properties of all lubes were measured after the product was hydrogenated under the following standard hydrogenation conditions to substantially remove unsaturation in the molecules. Under standard hydrogenation conditions, the fluid was mixed with between about 1 wt. % to about 2 wt. % of a 60% Ni-on-Kieselguhr catalyst, supplied by Aldrich Chemical Company, Milwaukee, Wis., in an autoclave and was hydrogenated at about 225° C. under about 800 pounds per square inch (psi) $H_2$ pressure for between about 8 hours to about 24 hours. The amount of Ni-on-Kieselguhr catalyst employed is dependent upon the relative purity of the unsaturated poly-alpha-olefin. For example, if the sample is substantially clear and/or colorless, Ni-on-Kieselguhr catalyst comprises about 1 wt. % of the total mixture. However, if the sample is colored, Ni-on-Kieselguhr catalyst comprises about 2 wt. % of the total mixture.

Viscosity was measured in the following examples according to the method described in ASTM D445 using a Cannon-Manning semi-micro viscometer. Viscosity Index (VI) was calculated according the method described in ASTM D2270. Pour point was measured by a Herzog Pour Point Apparatus which gives pour point results comparable to ASTM D97 method.

Percent lube yield was determined by dividing the weight of lube product recovered from the reaction by the weight of lube used in the reaction and multiplied by 100. Typically in the following examples, light ends, i.e. lubes having a boiling point below 750° F., were not generated as a product of the isomerization or hydrogenation reactions. However, when light ends were generated, which was rare, the product was distilled at 150° C. at a pressure of about 1 milli-torr for about two hours to remove the light end. Accordingly, when light ends were removed, the weight of the lube product recovered equaled the weight of the crude lube product minus the weight of the light end.

Feed Stock for the Examples

1-Hexadecene was polymerized using a promoted $BF_3$ catalyst to produce a polymeric mixture. From this crude mixture, a viscous fluid was isolated by distillation at about 130° C. at about 1 millitorr of vacuum for about 2 hours to remove unreacted starting material. This viscous fluid was used as starting material (Feed Stock 1) for the following examples.

Comparative Example 1

About one hundred grams of Feed Stock 1 was further hydrogenated over Ni-on-Kieselguhr catalyst as described above to remove any unsaturated component. The lube properties of the finished product are summarized in Table 1 as Comparative Example 1.

Example 2

About one hundred grams of Feed Stock 1 fluid was mixed with about one gram of a hydrogen form zeolite beta catalyst and heated to about 265° C. for about 24 hours. The liquid was filtered and hydrogenated under standard conditions to give a finished lube, whose properties are summarized in Table 1. The hydrogen form zeolite beta-treated lube has a pour point of about −51° C., which is a significant improvement over the untreated lube in Comparative Example 1.

Example 3

About one hundred grams of Feed Stock 1 fluid was mixed with about one gram of a platinum form zeolite beta catalyst and heated to about 265° C. for about 24 hours. The liquid was filtered and hydrogenated under standard conditions to give a finished lube, whose properties are summarized in Table 1. The platinum form zeolite beta-treated lube has a pour point of about −49° C., which is a significant improvement over the untreated lube in Comparative Example 1.

Example 4

About one hundred grams of Feed Stock 1 fluid was mixed with about one gram of a H-ZSM-12 catalyst was used and heated to about 265° C. for about 24 hours. The liquid was filtered and hydrogenated under standard conditions to give a finished lube, whose properties are summarized in Table 1. The H-ZSM-12 catalyst-treated lube has a pour point of about −56° C., which is a significant improvement over the untreated lube in Comparative Example 1.

Examples 5 to 8

About one hundred gram samples of Feed Stock 1 fluid were respectively mixed with one gram of zeolite catalysts of medium to large pores and heated to about 265° C. for about 24 hours. The respective liquids were filtered and hydrogenated under standard conditions to give finished lubes, whose properties are summarized in Table 1. In all cases, the pour points of the final lubes were significantly improved over the untreated lube in Comparative Example 1. Furthermore, in all cases, the lube yields were high ranging from 80 to 95%.

TABLE 1

Product Property Summary For Examples 1-8

| Example no. | Catalyst | Lube Yield, wt % | 100° C. Visc, cSt | 40° C. Visc., cSt | VI | Pour Point ° C. |
|---|---|---|---|---|---|---|
| Comparative Example 1 | none | — | 4.55 | 19.88 | 150 | −17 |
| 2 | H-Beta | Not measured | 6.62 | 42.42 | 109 | −51 |
| 3 | Pt-Beta | Not measured | 6.80 | 42.38 | 116 | −49 |
| 4 | H-ZSM12 | 91 | 5.03 | 25.73 | 124 | −56 |
| 5 | H-ZSM5 | 81 | 5.57 | 30.92 | 119 | −54 |
| 6 | Pt-ZSM48 | 95 | 4.65 | 21.73 | 135 | −42 |
| 7 | H-ZSM48 | 80 | 6.14 | 36.44 | 115 | −57 |
| 8 | H-ZSMSS | 99 | 4.57 | 20.85 | 138 | −30 |

Comparative Example 9 and Example 10

This example demonstrated that a poly-alpha-olefin prepared from mixed alpha-olefins can be treated with a zeolite catalyst to improve its properties. About 200 grams of a mixture containing about equal weights of 1-tetradecene, 1-hexadcene, and 1-octadecene was mixed with about two grams of a calcined MCM56 catalyst in a reactor and heated to about 200° C. for about 24 hours under inert nitrogen atmosphere. A viscous fluid was isolated by filtration of the catalyst and distillation at about 130° C. at about 1 millitorr of vacuum for about 2 hours to remove unreacted starting olefins. A portion of the viscous fluid was hydrogenated under standard conditions to give the Comparative Example 9, a finished lube of about 5.31 cSt at 100° C. and about −28° C. pour point. In Example 10, another portion of the viscous fluid was further treated with a Pt-ZSM48 catalyst at about 250° C. for about 24 hours, the resulting lube, after hydrogenation, had a viscosity of about 5.30 cSt at 100° C. and about −38° C. pour point.

Comparative Examples 11 and Example 12

This example demonstrated that, when an un-hydrogenated poly-alpha-olefin was treated in a similar manner as a conventional hydro-isomerization scheme, the lube properties were not improved. A poly-alpha-olefin was prepared by passing 1-hexadecene over a MCM 56 catalyst of a 30/80 mesh size at about 1 g/g-catalyst/hr at about 200° C. The effluent was collected over a ten-day period. A viscous fluid was isolated by distillation to remove any unreacted starting olefins. In Comparative Example 11, part of the viscous fluid was hydrogenated to give a lube product having a viscosity of about 4.93 cSt at 100° C. and about −45° C. pour point. In Example 12, another part of the viscous fluid was passed through a Pt-Z8M48 catalyst together with $H_2$ at about 200 cc/mm at about 250° C. at about 800 psi, the resulting lube product had a viscosity of about 4.96 cSt at 100° C. and about −47° C. pour point. This Example 12 demonstrated that when isomerization was carried out in the presence of hydrogen gas, the product pour point showed very little improvement, from −45° C. to −47° C.

Comparative Example 13

A viscous fluid was prepared by polymerizing 1-dodecene using a promoted $BF_3$ catalyst followed by distillation as described in Feed Stock 1 to remove any unreacted starting olefins. A portion of this viscous fluid (Feed Stock 2) was further hydrogenated under standard conditions to give Comparative Example 13, a poly-alpha-olefin with a viscosity of about 6.37 cSt, about 151 VI, and about −39° C. pour point.

Example 14

A portion of Feed Stock 2 from Comparative Example 13 was passed through a fixed bed catalyst containing Pt-ZSM23 at about 232° C. at about 0.5 ml/ml catalyst/hour. The treated poly-alpha-olefin was obtained in >95% yield and was then hydrogenated under typical conditions. The finished lube Example 14 had a 100° C. viscosity of about 6.31 cSt, about 142 VI, and about −57° C. pour point. The pour point of this sample was significantly improved over the Comparative Example 13 poly-alpha-olefin (about −39° C. pour point) without zeolite treatment. This example demonstrated that the process concept is applicable to dodecene-based poly-alpha-olefin.

Comparative Example 15

About 200 grams of 1-hexadecene and about 2 grams of a calcined MCM56 catalyst were mixed together in a flask and heated to about 200° C. for about 24 hours to produce Feed Stock 3. The mixture was cooled down and filtered to remove the catalyst. The liquid product was distilled to remove light component boiling below 700° F., and the lube fraction product was isolated in 87% yield. The lube properties after hydrogenation of Feed Stock 3 were summarized in Table 2 as Comparative Example 15.

Example 16

About 100 grams of Feed Stock 3 was mixed with about 1 gram of finely-ground Pt-ZSM48 catalyst and heated to about 250° C. for about 24 hours under inert nitrogen atmosphere. The lube product was isolated by filtering of the catalyst and followed by hydrogenation under standard conditions. The properties of this isomerized lube were summarized in Table 2.

These data showed that the isomerization of the un-hydrogenated poly-alpha-olefin reduced the pour point of the fluid to about −53° C. (Example 14) versus about −31° C. pour point for the un-isomerized PAO (Example 13). The yield for the isomerization was greater than 95%.

Comparative Example 17

Similar to Feed Stock 3, except about 200 grams of 1-octadecene was used as starting material and MCM56/alumina-bound catalyst was used to produce Feed Stock 4, which was then hydrogenated as described above.

Example 18

Isomerization of Feed Stock 4 was carried out in the similar manner as in Example 16. The product was hydrogenated in under standard conditions (Table 2.)

Comparative Example 19

Similar to Feed Stock 4, except about 200 grams of a mixture containing about 50 wt. % 1-tetradecene and about 50 wt. % 1-octadecene was used as starting material to produce Feed Stock 5. Feed Stock 5 was hydrogenated as above to produce Comparative Example 19 (Table 2.)

Example 20

Isomerization of Feed Stock 5 was carried out in the similar manner as in Example 16. The product was hydrogenated in under standard conditions (Table 2.)

Comparative Example 21

Similar to Feed Stock 3, except about 200 grams of a mixture containing equal weights of 1-tetradecene, 1-hexadecene, and 1-octadecene was used as starting material to produce Feed Stock 6. Feed Stock 6 was hydrogenated as above to produce Comparative Example 21 (Table 2.)

Example 22

Isomerization of Feed Stock 6 was carried out in the similar manner as in Example 16. The product was hydrogenated in under standard conditions (Table 2.)

TABLE 2

| Example no. | Lube Yield, wt % (about) | 100° C. Visc, cSt (about) | 40° C. Visc., cSt (about) | VI (about) | Pour Point ° C. (about) |
|---|---|---|---|---|---|
| Comparative 15 | 87 | 5.14 | 25.4 | 134 | −31 |
| 16 | >95 | 5.20 | 28.7 | 125 | −53 |
| Comparative 17 | 88.6 | 6.91 | 38.83 | 139 | −21 |
| 18 | 96 | 6.77 | 39.23 | 120 | −39 |
| Comparative 19 | 80.2 | 5.69 | 30.33 | 131 | −26 |
| 20 | 89 | 6.15 | 34.43 | 127 | −39 |
| Comparative 21 | — | 5.80 | 30.00 | 137 | −23 |
| 22 | 88 | 6.15 | 35.06 | 124 | −51 |

Feed Stock 7

About two grams of MCM56 catalyst of 30/80 mesh size was mixed with about 12 ml of inert quartz chip of 30/80 mesh size and packed into the center of a ½ inch, fixed-bed, tubular reactor to make up a total catalyst bed volume of about 16 ml. This reactor was heated to about 175° C. to about 200° C., and 1-hexadecene was passed through the reactor at about 2 cc/hour. The effluent was collected over about a 10 day period. The liquid product was distilled under vacuum as in Examples 1 and 9 to remove light end component.

Comparative Example 23

Feed Stock 7 was hydrogenated as described above. The properties of the residual lube product after hydrogenation are summarized in Table 3.

Example 24

About two grams of Pt-ZSM48 catalyst of 30/80 mesh size was mixed with about 12 ml of inert quartz chip of 30/80 mesh size and packed into the center of a ½ inch, fixed-bed, tubular reactor to make up a total catalyst bed volume of about 16 ml. The reactor was heated to about 250° C. reaction temperature and then Feed Stock 7 was fed through the reactor at about 2 cc/hr. The liquid product was collected and analyzed by gas chromatograph, distilled to remove any light ends as in Examples 1 and 9, and hydrogenated under standard hydrogenation conditions. The product properties were summarized in Table 3. These data showed that isomerization of the un-hydrogenated poly-alpha-olefin reduced its pour point from about −45° C. (Comparative Example 23) to about −63° C. (Example 24). The lube yield from the isomerization step was greater than 90%, and lube product maintained its excellent VI and low viscosity.

Comparative Example 25

Similar to Comparative Example 23, except that hydrogen was fed through the reactor simultaneously with the liquid feed to produce Feed Stock 8. This type of operation is similar to a typical hydro-isomerization process. The product (Feed Stock 8) contains significant amount of unsaturation and was further hydrogenated at standard conditions to produce Comparative Example 25. As this comparative example showed that conventional hydro-isomerization (or isomerization of olefins by metal-modified zeolite in the presence of hydrogen) process did not change the pour point significantly (about −47° C. versus the starting pour point of about −45° C.).

Example 26

In this example, about two grams of a Pt-ZSM48 catalyst of 30/80 mesh size was mixed with about 12 ml of inert quartz chip of 30/80 mesh size and packed into the center of a ½ inch tubular, first fixed-bed reactor to make up a total catalyst bed volume of about 16 ml. A second fixed-bed reactor was prepared by packing about two grams of a finely-crushed (30/80 mesh size) 65% Ni-on-Kieselguhr catalyst mixed with about 12 ml of inert quartz chip of 30/80 mesh size into the center of a ½ inch tubular, fixed-bed reactor. Both reactors were heated to about 250° C., and pressure was maintained at about 800 psi for both reactors. Feed Stock 7 was fed through the first reactor at about 2.5 cc/hr for isomerization. The effluent form the first reactor was piped through the second reactor where hydrogen was added at about 500 cc/hr. The properties of the first sample collected after about 24 hours on stream was summarized in Table 3. These data showed that by carrying out the reaction in two stages, isomerization followed by hydrogenation, the lube pour point was reduced from about −45° C. to less than about −65° C. Lube yield and viscometric remained excellent.

TABLE 3

| Example no. | Lube Yield, wt % | 100° C. Visc, cSt | 40° C. Visc., cSt | VI | Pour Point ° C. |
|---|---|---|---|---|---|
| Comparative 23 | 50-80 | 4.93 | 25.07 | 123 | −45 |
| 24 | 97 | 5.18 | 27.90 | 117 | −63 |
| Comparative 25 | 100 | 4.96 | 22.55 | 121 | −47 |
| 26 | 97 | 5.46 | 31.03 | 112 | <−65 |

In the above text and the appended claims, reference is made to olefins and polyolefins having certain numbers of carbon atoms in the structure thereof. This is indicated by the designation "C" with an integer in subscript. The integer indicates the number of carbon atoms present in the structure of the olefin or polyolefin. For example, a $C_{10}$ alpha-olefin means that the alpha-olefin has ten carbon atoms. When the subscript "+" is employed with the integer, the "+" means "and higher numbers of carbon atoms". For example, a $C_{10+}$ olefin includes $C_{10}$, $C_{12}$, $C_{14}$, etc. olefins.

Although the invention has been described in detail for the purpose of illustration, it is understood that such detail is solely for that purpose, and variations can be made therein by those skilled in the art without departing from the spirit and scope of the invention which is defined by the following claims.

Accordingly, the present invention also includes for certain jurisdictions:

1a. A process for preparing a saturated isomerized polyolefin comprising:

polymerizing a feed stock comprising an unsaturated olefin to form an unsaturated polyolefin;

isomerizing the unsaturated polyolefin in the presence of an acid catalyst in a substantially hydrogen-free environment to form an unsaturated-isomerized polyolefin; and hydrogenating the unsaturated-isomerized polyolefin to form the saturated isomerized polyolefin.

2a. The process according to 1a, wherein the unsaturated olefin comprises unsaturated, linear alpha-olefins; unsaturated, normal internal-olefins; unsaturated, branched alpha-olefins; unsaturated, branched internal-olefins; or a combination thereof.

3a. The process according to 2a, wherein the linear alpha-olefins comprise $C_8$ or greater linear alpha-olefins or a combination thereof.

4a. The process according to any one of 2a to 3a, wherein the linear alpha-olefins comprise $C_{10}$ to $C_{24}$ linear alpha-olefins or a combination thereof.

5a. The process according to any one of 2a to 4a, wherein the normal internal-olefins comprise $C_{10}$ or greater normal internal-olefins.

6a. The process according to any one of 2a to 5a, wherein the normal internal-olefins comprise $C_{12}$ to $C_{24}$ normal internal-olefins.

7a. The process according to any one of 2a to 6a, wherein the branched alpha-olefins comprise $C_8$ or greater branched alpha-olefins.

8a. The process according to any one of 2a to 7a, wherein the branched alpha-olefins comprise $C_{12}$ to $C_{24}$ branched alpha-olefins.

9a. The process according to any one of 2a to 8a, wherein the branched internal-olefins comprise $C_8$ or greater branched internal-olefins.

10a. The process according to any one of 2a to 9a, wherein the branched internal-olefins comprise $C_{12}$ to $C_{24}$ branched internal-olefins.

11a. The process according to any one of 1a to 10a, wherein the unsaturated olefin comprises $C_{8+}$ alpha-olefins and polymers thereof either individually or in any combination thereof; $C_{10+}$ dimers, trimers, co-dimers, co-trimers, and higher oligomers of normal alpha-olefins either individually or in any combination thereof; $C_{10+}$ linear internal olefins and polymers thereof either individually or in any combination thereof; $C_{8+}$ branched alpha- or internal-olefins and polymers thereof either individually or in any combination thereof; $C_{25+}$ linear poly-alpha-olefins, branched poly-alpha-olefins, linear internal-polyolefins, and branched internal-polyolefins either individually or in any combination thereof; or a mixture of any combination of the unsaturated olefins and polyolefins.

12a. The process according to any one of 1a to 11a, wherein the feed stock further comprises $C_2$ to $C_6$ unsaturated olefins.

13a. The process according to any one of 1a to 12a, wherein the acid catalyst has an alpha value of at least 1.

14a. The process according to any one of 1a to 13a, wherein the acid catalyst is a zeolite having a Constraint Index of about 12 or less.

15a. The process according to any one of 1a to 14a, wherein the acid catalyst is a zeolite having a Constraint Index of about 2 to about 12.

16a. The process according to any one of 1a to 15a, wherein the acid catalyst is selected from the group consisting of ZSM-3, ZSM-4, ZSM-5, ZSM-11, ZSM-12, ZSM-14, ZSM-18, ZSM-20, ZSM-22, ZSM-23, ZSM-35, ZSM-38, ZSM-48, ZSM-50, Zeolite Beta, Zeolite UHP—Y, ultrastable Y, dealuminized Y, clinoptilolite, mordenite, faujasite, offretite, and any combination thereof.

17a. The process according to any one of 1a to 16a, wherein the acid catalyst is a homogeneous acid catalyst selected from Friedel-Crafts catalysts, Bronsted acids, Lewis acids, or any combination thereof.

18a. The process according to any one of 1a to 17a, wherein the acid catalyst is a homogeneous acid catalyst selected from $BF_3$, $BCl_3$, $BBr_3$, $AlCl_3$, $AlBr_3$, $SbF_5$, $TiCl_3$, $TiCl_4$, $SnCl_4$, $PF_5$, $SnF_4$, $H_2SO_4HCOOH$, HF, HCl, HBr, triflic acid, or a combination thereof.

19a. The process according to any one of 1a to 18a, wherein the acid catalyst is a boron halide, an aluminum halide, or a combination thereof.

20a. The process according to any one of 1a to 19a, wherein the acid catalyst is selected from the group consisting of MCM-22, MCM-36, MCM-49, MCM-56, MCM-68, and a combination thereof.

21a. The process according to any one of 1a to 20a, wherein the acid catalyst comprises zeolites; homogeneous acid catalysts; acidic resins; acidic solid oxides; acidic silicoaluminophosphates; Group IVB metal oxides; oxide, hydroxide, or free metal forms of Group VIII metals, Group IVA metals, Group VB metals, and Group VIIB metals; or any combination thereof.

22a. The process according to any one of 1a to 21a, wherein the acid catalyst comprises a Group VIIIB metal deposited on a zeolite.

23a. The process according to any one of 1a to 22a, wherein the saturated isomerized polyolefin has a pour point of less than or equal to about −30° C.

24a. The process according to any one of 1a to 23a, wherein the saturated isomerized polyolefin has a pour point of less than or equal to about −40° C.

25a. The process according to any one of 1a to 24a, wherein the saturated isomerized polyolefin has a pour point of less than or equal to about −50° C.

26a. The process according to any one of 1a to 25a, wherein the saturated isomerized polyolefin has a viscosity of less than about 200 cSt at 100° C.

27a. The process according to any one of 1a to 26a, wherein the saturated isomerized polyolefin has a viscosity of less than about 10 cSt at 100° C.

28a. The process according to any one of 1a to 27a, wherein the saturated isomerized polyolefin has a viscosity of less than about 50 cSt at 40° C.

29a. The process according to any one of 1a to 28a, wherein the saturated isomerized polyolefin has a viscosity index of greater than or equal to about 50.

30a. The process according to any one of 1a to 29a, wherein the saturated isomerized polyolefin has a viscosity index of greater than or equal to about 100.

31a. The process according to any one of 1a to 30a, wherein the saturated isomerized polyolefin has a viscosity index of greater than or equal to about 120.

32a. The process according to any one of 1a to 31a, wherein the saturated isomerized polyolefin has a volatility of less than or equal to a $C_8$-$C_{10}$ poly-alpha-olefin having a comparable molecular weight.

33a. A process for preparing a saturated isomerized polyolefin comprising:

polymerizing a feed stock comprising an unsaturated olefin to form an unsaturated polyolefin;

isomerizing the unsaturated polyolefin by contacting the unsaturated polyolefin with an acidic zeolite catalyst at a temperature of about 200° C. to about 475° C. in an essentially hydrogen free environment, to produce an unsaturated-isomerized polyolefin, wherein the zeolite catalyst has a constraint index of less than or equal to 12; and hydrogenating the unsaturated-isomerized polyolefin to produce a saturated isomerized polyolefin.

34a. The process according to 33a, wherein the unsaturated olefin comprises $C_{8+}$ alpha-olefins and polymers thereof either individually or in any combination thereof; $C_{10+}$ dimers, trimers, co-dimers, co-trimers, and higher oligomers of normal alpha-olefins either individually or in any combination thereof; $C_{10+}$ linear internal olefins and polymers thereof either individually or in any combination thereof; $C_{8+}$ branched alpha- or internal-olefins and polymers thereof either individually or in any combination thereof; $C_{25+}$ linear poly-alpha-olefins, branched poly-alpha-olefins, linear internal-polyolefins, and branched internal-polyolefins either individually or in any combination thereof; or a mixture of any combination of the unsaturated olefins and polyolefins.

35a. The process according to 33a or 34a, wherein the feed stock further comprises $C_2$ to $C_6$ unsaturated olefins.

36a. The process according to any one of 33a to 35a, wherein the zeolite catalyst is selected from the group consisting of ZSM-5, ZSM-11, ZSM-12, ZSM-22, ZSM-23, ZSM-35, ZSM-38, ZSM-48, and a combination thereof.

37a. The process according to any one of 33a to 36a, wherein the zeolite catalyst is ZSM-22.

38a. The process according to any one of 33a to 37a, wherein the catalyst is a zeolite having a Constraint Index of about 2-12.

39a. The process according to any one of 33a to 38a, wherein the catalyst further comprises a homogeneous acid catalyst; an acidic resin; an acidic solid oxide; an acidic silicoaluminophosphate; a Group IVB metal oxide; an oxide of a Group VIII, IVA, or VB metal, a hydroxide of a Group VIII, IVA, or VB metal, a free of Group VIII, IVA, or VB metal; or any combination thereof.

40a. A lube oil comprising the saturated-isomerized polyolefin of any one of 1a to 39a.

We claim:

1. A process for preparing a saturated isomerized polyolefin comprising:

polymerizing a feed stock comprising at least one $C_8$ or greater unsaturated olefin in the presence of an acid catalyst to form an unsaturated polyolefin;

isomerizing the unsaturated polyolefin in the presence of an acid catalyst in a substantially hydrogen-free environment, at a temperature in the range of 150° to 475° C. to form an unsaturated-isomerized polyolefin; and hydrogenating the unsaturated-isomerized polyolefin to form the saturated isomerized polyolefin.

2. The process according to claim 1, wherein the unsaturated olefin comprises unsaturated, linear alpha-olefins; unsaturated, normal internal-olefins; unsaturated, branched alpha-olefins; unsaturated, branched internal-olefins; or a combination thereof.

3. The process according to claim 2, wherein the linear alpha-olefins comprise $C_8$ or greater linear alpha-olefins or a combination thereof.

4. The process according to claim 2, wherein the linear alpha-olefins comprise $C_{10}$ to $C_{24}$ linear alpha-olefins or a combination thereof.

5. The process according to claim 2, wherein the normal internal-olefins comprise $C_{10}$ or greater normal internal-olefins.

6. The process according to claim 2, wherein the normal internal-olefins comprise $C_{12}$ to $C_{24}$ normal internal-olefins.

7. The process according to claim 2, wherein the branched alpha-olefins comprise $C_8$ or greater branched alpha-olefins.

8. The process according to claim 2, wherein the branched alpha-olefins comprise $C_{12}$ to $C_{24}$ branched alpha-olefins.

9. The process according to claim 2, wherein the branched internal-olefins comprise $C_8$ or greater branched internal-olefins.

10. The process according to claim 2, wherein the branched internal-olefins comprise $C_{12}$ to $C_{24}$ branched internal-olefins.

11. The process according to claim 1, wherein the unsaturated olefin comprises $C_{8+}$ alpha-olefins and polymers thereof either individually or in any combination thereof; $C_{10+}$ dimers, trimers, co-dimers, co-trimers, and higher oligomers of normal alpha-olefins either individually or in any combination thereof; $C_{10+}$ linear internal olefins and polymers thereof either individually or in any combination thereof; $C_{8+}$ branched alpha- or internal-olefins and polymers thereof either individually or in any combination thereof; $C_{25+}$ linear poly-alpha-olefins, branched poly-alpha-olefins, linear internal-polyolefins, and branched internal-polyolefins either individually or in any combination thereof; or a mixture of any combination of the unsaturated olefins and polyolefins.

12. The process according to claim 11, wherein the feed stock further comprises $C_2$ to $C_6$ unsaturated olefins.

13. The process according to claim 1, wherein the acid catalyst used for isomerizing the unsaturated polyolefin has an alpha value of at least 1.

14. The process according to claim 1, wherein the acid catalyst used for isomerizing the unsaturated polyolefin is a zeolite having a Constraint Index of about 12 or less.

15. The process according to claim 1, wherein the acid catalyst used for isomerizing the unsaturated polyolefin is a zeolite having a Constraint Index of about 2 to about 12.

16. The process according to claim 1, wherein the acid catalyst used for isomerizing the unsaturated polyolefin is selected from the group consisting of ZSM-3, ZSM-4, ZSM-5, ZSM-11, ZSM-12, ZSM-14, ZSM-18, ZSM-20, ZSM-22, ZSM-23, ZSM-35, ZSM-38, ZSM-48, ZSM-50, Zeolite Beta, ultrastable Y, dealuminized Y, clinoptilolite, mordenite, faujasite, offretite, and any combination thereof.

17. The process according to claim 1, wherein the acid catalyst used for isomerizing the unsaturated polyolefin is a homogeneous acid catalyst selected from Friedel-Crafis catalysts, Bronsted acids, Lewis acids, or any combination thereof.

18. The process according to claim 1, wherein the acid catalyst used for isomerizing the unsaturated polyolefin is a homogeneous acid catalyst selected from $BF_3$, $BCl_3$, $BBr_3$, $AlCl_3$, $AlBr_3$, $SbF_5$, $TiCl_3$, $TiCl_4$, $SnCl_4$, $PF_5$, $SnF_4$, $H_2SO_4$, HCOOH, HF, HCl, HBr, triflic acid, or a combination thereof.

19. The process according to claim 1, wherein the acid catalyst used for isomerizing the unsaturated polyolefin is a boron halide, an aluminum halide, or a combination thereof.

20. The process according to claim 1, wherein the acid catalyst used for isomerizing the unsaturated polyolefin is selected from the group consisting of MCM-22, MCM-36, MCM-49, MCM-56, MCM-68, and a combination thereof.

21. The process according to claim 1, wherein the acid catalyst used for isomerizing the unsaturated polyolefin comprises zeolites; homogeneous acid catalysts; acidic resins; acidic solid oxides; acidic silicoaluminophosphates; Group IVB metal oxides; oxide, hydroxide, or free metal forms of Group VIII metals, Group IVA metals, Group VB metals, and Group VIIB metals; or any combination thereof.

22. The process according to claim 1, wherein the acid catalyst used for isomerizing the unsaturated polyolefin comprises a Group VIIIB metal deposited on a zeolite.

23. The process according to claim 1, wherein the saturated isomerized polyolefin has a pour point of less than or equal to about −30° C.

24. The process according to claim 1, wherein the saturated isomerized polyolefin has a pour point of less than or equal to about −40° C.

25. The process according to claim 1, wherein the saturated isomerized polyolefin has a pour point of less than or equal to about −50° C.

26. The process according to claim 1, wherein the saturated isomerized polyolefin has a viscosity of less than about 200 cSt at 100° C.

27. The process according to claim 1, wherein the saturated isomerized polyolefin has a viscosity of less than about 10 cSt at 100° C.

28. The process according to claim 1, wherein the saturated isomerized polyolefin has a viscosity of less than about 50 cSt at 40° C.

29. The process according to claim 1, wherein the saturated isomerized polyolefin has a viscosity index of greater than or equal to about 50.

30. The process according to claim 1, wherein the saturated isomerized polyolefin has a viscosity index of greater than or equal to about 100.

31. The process according to claim 1, wherein the saturated isomerized polyolefin has a viscosity index of greater than or equal to about 120.

32. The process according to claim 1, wherein the saturated isomerized polyolefin has a volatility of less than or equal to a $C_8$-$C_{10}$ poly-alpha-olefin having a similar molecular weight.

33. The process according to claim 1, wherein the acid catalyst used for isomerizing the unsaturated polyolefin is a zeolite containing one or more Group VI B to VIIIB metal elements.

34. The process according to claim 1, wherein the acid catalyst used for isomerizing the unsaturated polyolefin is a zeolite containing one or more metals selected from the group consisting of Pt, Pd, Ni, Co, Rh, Ir, Ru, W, Mo, and a combination thereof.

35. A process for preparing a saturated isomerized polyolefin comprising:

polymerizing a feed stock comprising an at least one $C_8$ or greater unsaturated olefin in the presence of an acid catalyst to form an unsaturated polyolefin;

isomerizing the unsaturated polyolefin by contacting the unsaturated polyolefin with an acidic zeolite catalyst at a temperature of about 200° C. to about 475° C. in an essentially hydrogen free environment, to produce an unsaturated-isomerized polyolefin, wherein the zeolite catalyst has a constraint index of less than or equal to 12; and hydrogenating the unsaturated-isomerized polyolefin to produce a saturated isomerized polyolefin.

36. The process according to claim 35, wherein the unsaturated olefin comprises $C_{8+}$ alpha-olefins and polymers thereof either individually or in any combination thereof; $C_{10+}$ dimers, trimers, co-dimers, co-trimers, and higher oligomers of normal alpha-olefins either individually or in any combination thereof; $C_{10+}$ linear internal olefins and polymers thereof either individually or in any combination thereof; $C_{8+}$ branched alpha- or internal-olefins and polymers thereof either individually or in any combination thereof; $C_{25+}$ linear poly-alpha-olefins, branched poly-alpha-olefins, linear internal-polyolefins, and branched internal-polyolefins either individually or in any combination thereof; or a mixture of any combination of the unsaturated olefins and polyolefins.

37. The process according to claim 36, wherein the feed stock further comprises $C_2$ to $C_6$ unsaturated olefins.

38. The process according to claim 35, wherein the acidic zeolite catalyst is selected from the group consisting of ZSM-5, ZSM-11, ZSM-12, ZSM-22, ZSM-23, ZSM-35, ZSM-38, ZSM-48, and a combination thereof.

39. The process according to claim 35, wherein the acidic zeolite catalyst is ZSM-22, ZSM-23 or ZSM-48.

40. The process according to claim 35, wherein the acidic zeolite catalyst has a Constraint Index of about 2-12.

41. The process according to claim 35, wherein the acidic zeolite catalyst contains one or more Group VI B to VIIIB metal elements.

42. The process according to claim 35, wherein the acidic zeolite catalyst contains one or more metals selected from the group consisting of Pt, Pd, Ni, Co, Rh, Ir, Ru, W, Mo, and a combination thereof.

43. A lube oil comprising the saturated-isomerized polyolefin of claim 35.

* * * * *